US005997722A

United States Patent [19]

Vidal et al.

[11] Patent Number: 5,997,722

[45] Date of Patent: Dec. 7, 1999

[54] ELECTROCHEMICAL SURFACE TREATMENT

[75] Inventors: Alexandra I. Vidal, Webster; William G. Herbert, Williamson; Roberto W. Vidal, Webster; Gary J. Maier, Webster; Jodie L. Morris, Webster; James E. McNamara, Sodus; Gene W. O'Dell, Williamson, all of N.Y.

[73] Assignee: Xerox Corporation, Stamford, Conn.

[21] Appl. No.: 09/103,690

[22] Filed: Jun. 24, 1998

Related U.S. Application Data

[63] Continuation-in-part of application No. 08/752,189, Nov. 18, 1996, abandoned.

[51] Int. Cl.[6] ..... C25F 1/00

[52] U.S. Cl. ..... 205/711; 205/658; 205/81; 205/151

[58] Field of Search ..... 205/711, 658, 205/219, 81, 198, 151; 427/327, 435, 421

[56] References Cited

U.S. PATENT DOCUMENTS

| | | | |
|---|---|---|---|
| 4,134,763 | 1/1979 | Fujimura et al. | 427/327 |
| 4,481,090 | 11/1984 | Childs | 204/129.75 |
| 4,678,546 | 7/1987 | Yu-Zhong | 204/32.1 |
| 5,080,993 | 1/1992 | Maruta et al. | 430/128 |

*Primary Examiner*—Kathryn Gorgos
*Assistant Examiner*—Thomas H Parsons
*Attorney, Agent, or Firm*—Zosan S. Soong

[57] ABSTRACT

A method for producing a photoreceptor having a substrate subjected to a surface finishing treatment to result in a finished substrate surface, wherein the method includes:

(a) analyzing the finished substrate surface by performing a first surface energy reading, a first ellipsometry reading, a first x-ray diffraction reading, and a first profilometry reading;

(b) removing electrochemically via an alternating voltage or alternating current a portion of the finished substrate surface, thereby resulting in a cleaned substrate surface;

(c) analyzing the cleaned substrate surface by performing a second surface energy reading, a second ellipsometry reading, a second x-ray diffraction reading, and a second profilometry reading, wherein the removing step (b) is accomplished to the extent that the second surface energy reading and the second ellipsometry reading are measurably changed from the first surface energy reading and the first ellipsometry reading, but the second x-ray diffraction reading and the second profilometry reading are measurably unchanged from the first x-ray diffraction reading and the first profilometry reading; and (d) depositing a layer of the photoreceptor on the cleaned substrate surface.

15 Claims, No Drawings

ELECTROCHEMICAL SURFACE TREATMENT

CROSS REFERENCE TO RELATED APPLICATIONS

This application is a continuation-in-part of U.S. patent application Ser. No. 08,752,189, filed Nov. 18, 1996, abandoned, the disclosure of which is totally incorporated herein by reference.

FIELD OF THE INVENTION

This invention relates to an electrochemical treatment that cleans the surface of a substrate prior to subsequent processing steps involving for example the fabrication of a photoreceptor.

BACKGROUND OF THE INVENTION

Depending on the photoreceptor surface finish needed, a substrate may be subjected to a surface finishing treatment such as lathing to produce a rough surface or a smoother mirror-like surface or honing which involves spraying a mixture of a liquid and abrasive particles against the substrate surface to produce the desired surface characteristics. Presently, these surface finishing treatments are performed with an aqueous type cutting fluid. Residues of this fluid, along with other debris, often reside on the interior and exterior of the substrate. Then, the substrates are cleaned with an aqueous cleaning process prior to coating. Recent studies have shown that the aqueous cleaning process experiences limitations with exceedingly dirty incoming substrates. Also, there is data that indicates that the detergent presently used in the aqueous cleaning process is corrosive and may form micelles. Other documented setbacks of the aqueous cleaning process involve significant instrumentation downtime and a suspected cause of dermatitis. Finally, the nature of the aqueous cleaning process does not allow for direct process control; the only controllable parameters are detergent conductivity, temperature, and ultrasonic settings. Thus, the present invention addresses the above described problems of the aqueous cleaning process by providing one or more of the following benefits: stronger cleaning power, faster cycle time, direct control, mechanical reliability, and use of stable, safe, and environmentally benign chemicals.

Conventional surface treatment methods are disclosed in Maruta et al., U.S. Pat. No. 5,090,993; Yu-Zhong, U.S. Pat. No. 4,678,546; and Childs, U.S. Pat. No. 4,481,090.

SUMMARY OF THE INVENTION

The present invention is accomplished in embodiments by providing a method for producing a photoreceptor having a substrate subjected to a surface finishing treatment to result in a finished substrate surface, wherein the method comprises:

(a) analyzing the finished substrate surface by performing a first surface energy reading, a first ellipsometry reading, a first x-ray diffraction reading, and a first profilometry reading;

(b) removing electrochemically via an alternating voltage or alternating current a portion of the finished substrate surface, thereby resulting in a cleaned substrate surface;

(c) analyzing the cleaned substrate surface by performing a second surface energy reading, a second ellipsometry reading, a second x-ray diffraction reading, and a second profilometry reading, wherein the removing step (b) is accomplished to the extent that the second surface energy reading and the second ellipsometry reading are measurably changed from the first surface energy reading and the first ellipsometry reading, but the second x-ray diffraction reading and the second profilometry reading are measurably unchanged from the first x-ray diffraction reading and the first profilometry reading; and (d) depositing a layer of the photoreceptor on the cleaned substrate surface.

In embodiments of the present invention, the substrate is at least partially immersed in an electrolytic solution, and further comprising a step (e) selected from the group consisting of:

(i) directing ultrasonic sound at the substrate;

(ii) moving the substrate; and (iii) agitating the electrolytic solution, wherein the step (e) occurs during at least a portion of the removal step (b).

DETAILED DESCRIPTION

As used herein, the phrase "measurably changed" means that the test method reveals a difference which is not attributable to any natural variance in the test method. As used herein, the phrase "measurably unchanged" means that the test method fails to detect a difference not attributable to any natural variance in the test method. Where the differences are expressed in percentages such as 5%, this is determined by subtracting the parameter values for the treated and untreated surfaces and by dividing this difference by the parameter value for the untreated surface.

The present invention cleans the substrate surface prior to subsequent processing steps such as those involving the fabrication of a photoreceptor. In certain embodiments, in addition to the cleaning treatment, the present invention also forms a metal oxide layer on the substrate surface, or increases the thickness of an already formed metal oxide layer. This electrochemical treatment suppresses surface asperities (such as small metal flakes and small metal fibers) which result from mechanical treatments such as lathing or from material handling procedures and/or removes surface impurities which may result from organic residues used as coolants or lubricants and from other environmental contaminants in the makeup of the substrate surface. The present substrate surface treatment improves certain characteristics of the resulting photoreceptor by minimizing or eliminating for example charge-deletion spots and bias charge roll leaks.

A general description of the electrolytic process now follows. In the electrolytic cell, the working electrode is the photoreceptor substrate. The counter electrode preferably is concentric, preferably surrounding the exterior of the substrate. To simultaneously clean the interior of the substrate in the case of a cylindrical substrate, a concentric counter-electrode may be disposed in the interior of the substrate. The counterelectrode or electrodes may be a noble metal such as gold, silver, platinum, palladium; an inert material such as graphite; or a strongly passive material such as titanium, lead, tantalum, or alloys thereof. The cell voltage is modulated with a power source capable Of delivering alternating voltage ("AV") or alternating current ("AC") at a certain frequency described herein. Metal dissolution is accompanied by significant evolution of hydrogen and oxygen gas. The gas serves the purpose of mechanical scrubbing, increasing convection, and creating local pH changes that favor the substrate metal dissolution reaction.

Appropriate electrochemical parameters are important to obtaining the surface finish desired. The modulated RMS (cell) voltage range varies between about 5 to about 35 V. A voltage offset (DC bias) may also be used and may vary between about 0.1 ±10 V. Although the resulting current is sinusoidal, it is not necessarily linear. However, the preferred maximum AC current density ranges between about 10 to about 100 mA/cm$^2$. Since the operating currents are high, the IR (i.e., current-resistance) drop is important. Thus, it is specific that the RMS working electrode potential ranges between about ±10 V, as measured with an identical material just outside the substrate surface. In practice, this quantity is derived by the extrapolation of electrode-potential measurements with a reference electrode at different distances. The range of frequencies employed in the present invention is about 10 to about 10,000 Hz., preferably from about 20 to about 500 Hz, and more preferably from about 40 to about 100 Hz. The electrochemical treatment may vary between about 5 seconds and 5 minutes, and preferably from about 15 seconds to about 2 minutes. The electrochemical treatment of the present invention removes a thin portion of the substrate surface. For example, in one embodiment, the present invention removes the surface of a substrate having a 1 mm wall thickness to a depth of about $1\times10^{-4}$%. In embodiments, the present method may remove the surface of a substrate to a depth ranging from about 5 to about 100 angstroms, preferably from about 8 to about 20 angstroms, and especially about 10 angstroms.

A hot (about 80° C.) water rinse may be used after the electrochemical treatment for the purpose of quick drying. The water adhesion on the cleaned surface is an indication of uniformity of the surface tension (also referred herein as "surface energy"). Thus, a uniform adhesion of the water after a hot water rinse is indicative that the surface is free of contaminants that would alter locally the surface tension. It has been found that the water adhesion on the substrate surface subjected to the present invention demonstrates better uniformity than the aqueous cleaning process described earlier.

The electrolyte used may be any combination of dilute (for example about 1 wt %) or concentrated (for example about 20 wt %) neutral salts in a buffered solution. Examples of suitable salts include for instance sodium citrate, sodium sulfate, sodium nitrate, sodium carbonate, sodium chloride, and others. Typical buffer couples include borax/HCl or triethanolamine/HCl. The buffer concentration can be varied in a way that the electrolyte pH range is from about 3 to about 10, preferably from about 6 to about 9, and especially from about 6.5 to about 7.5. The bath may also contain organic or inorganic additives to selectively aid the stability of alloying cations. Examples of additives include cyanide ions and ammonia molecules. At atmospheric pressure, the electrolyte temperature is approximately 25° C. However, the present invention may be used at any suitable temperature including from about 25 to about 70° C.

In embodiments, there is formed a metal oxide layer on the substrate surface wherein the metal oxide layer added by the present method has a thickness ranging from about 50 to about 200 angstroms, and preferably from about 70 to about 150 angstroms. The metal oxide may be for example aluminum oxide.

The present method measurably changes the surface energy of the substrate surface. Surface energy is the ability of a liquid to wet a surface; high values correspond to good wettability. Typically, it is measured at an interface such as the photoreceptor substrate and a liquid of high surface tension by using a graduated magnifying glass. As the liquid forms a bubble, the angle of contact is measured internally. The present method preferably increases the surface energy of the substrate surface by an effective amount, as compared with the substrate surface prior to the electrochemical surface treatment, to allow a photoreceptor coating to be uniformly deposited on the substrate surface (i.e., no gaps in coverage) and at a uniform thickness. In embodiments of the present invention, an increase in the contact angle of preferably 5.0 degrees or larger constitutes a measurable change in the surface energy. The surface energy of the cleaned substrate surface is increased by at least about 5%, preferably at least about 10%, more preferably from about 10% to about 20%, from the surface energy prior to the electrochemical treatment. When the surface energy increases, the contact angle decreases. In embodiments, the substrate surface may have a contact angle prior to the electrochemical cleaning and after the surface finishing treatment of 50 degrees, but a contact angle subsequent to the electrochemical cleaning step ranging from about 10 to about 40 degrees, and preferably from about 23 to about 33 degrees.

The present method fails to measurably change the x-ray diffraction reading. This technique may be used to determine the crystalline or amorphous structure of a film. X-ray diffraction traces may be collected using a Siemens D5000 X-Ray Powder Diffraction system. The traces may be collected in step scan mode over a range of 5–60 two-theta with a step size of 0.01 degrees and a counting time of three seconds at each step. X-ray radiation of the $CuK_\alpha$ wavelength (0.15418 nm) may used. The diffractometer may be fitted with a nickel filter and pulse height discrimination may be used to ensure that only $CuK_\alpha$ radiation of narrow wavelength is collected. Failure to detect differences in the diffraction spectra (i.e. spectra are superposable and no distinct peaks are noticed) suggests that either the film formed during the treatment is either amorphous or too thin (within 500 Å). Thus, the technique used to determine whether there is a measurable change in the x-ray diffraction reading is by superposing the spectra. Preferably, the x-ray diffraction reading indicates that the measured substrate surface is amorphous and that the reading remains measurably unchanged by the present method.

The present method measurably changes the ellipsometry reading. Ellipsometry may be used to measure the real and imaginary components of the refractive index of a surface with a Sofi Digisel IR Ellipsometer. Samples may be tested in the presence and absence of room light. Based on the relative variation of the measurements, the ellipsometer computes a possible film thickness. An across-drum scan may be run with an ellipsometer laser wavelength of 1.3 microns. Failure to obtain identical readings in treated and untreated surfaces within 1% may suggest that a surface film is either absent or too thin (below 2,000 Å) to be determined. In the present method, a variance in the ellipsometry readings for the untreated and treated surfaces of preferably 1.0% and higher constitutes a measurable change. In embodiments, the ellipsometry readings for the untreated and treated surfaces may measurably change from 1.0% to about 250%.

The present method fails to measurably change the profilometry reading. Surface profilometry may be used to characterize the change in relevant statistically determined roughness parameters. Measurements may be recorded with a Perthen Profilometer (PRK S8P). A 5 $\mu$m probe (RFHTB-50) may be used. Measurements may be made along a 5 mm distance or thereabouts. To minimize measurement errors, some readings may be taken on a partially treated substrate; simultaneous readings may be recorded at the treated and untreated portions. In the present invention, a difference preferably of 5.0% or smaller in average roughness ($R_a$) and maximum roughness ($R_{max}$) for the untreated and treated surfaces is considered a non-measurable change.

In certain embodiments, the electrochemical impedance of the cleaned substrate surface is measurably changed, particularly in those embodiments where the present method forms a metal oxide layer on the substrate surface or adds to an already formed metal oxide layer. The electrochemical impedance of a surface reflects its ability to block the flow of electrons. It may be measured with two or three electrode systems. This blockage may be due to the presence of surface oxide films. Current uniformity and (sometimes) film thickness may be evaluated with AC-Impedance Spectroscopy. A Quad Tech. 7400 Precision RLC Meter is suitable for the application. Measurements may be recorded at room temperature over a predetermined superficial area. An aqueous solution of potassium sulfate may be used to minimize ohmic contributions of the electrolyte. The perturbing signal used in these measurements may be 1 V RMS ("root mean square") or others so long as the linearity of the measurement is maintained. To increase the validity of the measurements, each value reported may represent the arithmetic average of five sequential measurements. The frequency spectra of the perturbing signal may vary between 10 Hz–100 kHz. In the present invention, a difference preferably of at least 3.0% in amplitude and/or phase shift is considered a measurable electrochemical-impedance difference between the untreated and treated surfaces. The present invention increases the impedance of the cleaned substrate surface, but the increased impedance value preferably is below the impedance value obtained by conventional anodizing treatments. In certain embodiments of the present invention, the impedance is increased by preferably about 5% to about 3,000%, more preferably about 300% to about 1,500%, and especially about 600% to about 800%, for a given 0.22 $cm^2$ superficial surface area.

The substrate preferably is a hollow cylinder and defines a top non-imaging portion, a middle imaging portion, and a bottom non-imaging portion. The precise dimensions of these three substrate portions vary in embodiments. As illustrative dimensions, the top non-imaging portion ranges in length from about 10 to about 50 mm, and preferably from about 20 to about 40 mm. The middle imaging portion may range in length from about 200 to about 400 mm, and preferably from about 250 to about 300 mm. The bottom non-imaging portion may range in length from about 10 to about 50 mm, and preferably from about 20 to about 40 mm. The substrate may be bare of layered material or may be coated with a layered material such as those described herein prior to immersion of the substrate into the coating solution.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The coated or uncoated substrate can be flexible or rigid, and can have any number of configurations such as a cylindrical drum, an endless flexible belt, and the like.

The layer of the photoreceptor may be deposited on the cleaned substrate surface by any suitable technique including for example dip coating, vacuum deposition, and the like. An illustrative dip coating technique is now described. A chucking apparatus engages the top end of the substrate and lowers the bottom non-imaging portion, the middle imaging portion, and optionally a part of the top non-imaging portion into the coating solution. There may be an optional pause, which may last for example from about 1 to about 60 seconds, where the substrate is motionless after lowering of the substrate into the coating solution to permit any disturbance in the coating solution to dissipate. A part of the middle imaging portion, preferably the entire length thereof, is raised from the coating solution at a generally constant take-up speed which may be for example from about 50 to about 500 mm/min, preferably from about 100 to about 200 mm/min. The phrase generally constant speed encompasses deviations from the constant speed up to about 10% in magnitude. A generally constant speed (referred herein as "constant speed") is preferred for the entire length of the middle imaging portion since the constant speed produces a coating having a substantially uniform thickness which is desirable in certain embodiments for a photosensitive member. In embodiments, the generally constant take-up speed is typically maintained until the junction between the middle imaging portion and the bottom non-imaging portion. To ramp up to the constant speed, the part of the top non-imaging portion immersed in the coating solution is raised out of the coating solution at a take-up speed which starts from 0 and increases to the constant speed.

The bottom non-imaging portion is raised out of the coating solution at a take-up speed which is decreasing from the take-up speed of the substrate at the junction between the middle imaging portion and the bottom non-imaging portion. In one approach, the take-up speed is not reduced to 0 prior to or during movement of the bottom non-imaging portion out of the coating solution. The take-up speed for raising the bottom non-imaging portion is decreased, preferably at a constant rate, to a final speed (referred herein as "final speed") from the take-up speed of the substrate at the junction (referred herein as "junction speed") between the middle imaging portion and the bottom non-imaging portion. The final speed may be for example below 50 mm/min, preferably from about 5 to about 25 mm/min, and especially about 10 mm/min. The take-up speed may be decreased to the final speed at a rate, for example, from about 5 to about 40 mm/min per mm, preferably from about 10 to about 30 mm/min per mm, and more preferably from about 20 to about 25 mm/min per mm.

When the substrate is coated with the desired layer or layers, the coated substrate is then subjected to elevated temperatures such as from about 100 to about 160 degrees Centigrade for about 0.2 to about 2 hours.

Any suitable apparatus may be employed to hold and move the substrate including the apparatus disclosed in Pietrzykowski, Jr. et al., U.S. Pat. No. 5,334,246, the disclosure of which is totally incorporated herein by reference. A preferred equipment to control the speed of the substrate is available from Allen-Bradley Corporation and involves a programmable logic controller with an intelligent motion controller.

The coating solution may comprise any suitable liquid including solutions typically employed to coat layered material on the substrate during fabrication of photosensitive or photoconductive members. For example, the coating solution may comprise components for the charge transport layer and/or the charge generating layer, such components and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference. In embodiments, the coating solution may be formed by dispersing a charge generating material selected from azo pigments such as Sudan Red, Dian Blue, Janus Green B. and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

A coating solution may contain a solvent, preferably an organic solvent, such as one or more of the following: tetrahydrofuran, monochlorobenzene, and cyclohexanone.

The coating solution may also comprise materials typically employed as a subbing layer, barrier layer, adhesive layer, and the like. Accordingly, the coating solution may comprise, for example, casein, polyvinyl alcohol, nitrocellulose, ethyleneacrylic acid copolymer, polyamide (nylon 6, nylon 66, nylon 610, copolymerized nylon, alkoxymethylated nylon, and the like), polyurethane, gelatin, polyester, polyvinylbutyral, polyvinylpyrrolidone, polycarbonate, polyurethane, polymethyl methacrylate, and the like as well as mixtures thereof.

Under certain conditions, the present electrochemical surface treatment (also referred herein as the electrochemical removal process) may undesirably produce streaks on the substrate surface. The streaks are believed to be caused by the gas bubbles evolved at the diffusion layer on the substrate surface during the electrochemical surface treatment. The diffusion layer is the area where the chemical reaction takes place on the surface of the substrate. The gas bubbles are thought to generate shiny areas or streaks on the substrate surface as they traverse along the substrate surface. The streaks are shiny in appearance and are not visible under the microscope. It is unclear at this time whether the streaks can cause a functional problem in a photoreceptor incorporating the substrate, but the streaks are visible to the eye and are thus undesirable. Through experimentation, it is known that the streaks get worse as the time of the electrochemical surface treatment increases (shorter time yields fewer streaks). It is also known that a lower voltage will also reduce the occurrence of streaks (lower voltage yields fewer streaks). It is also known that the shiny areas or streaks follow the paths of the gas bubbles as they move along the substrate surface.

To minimize or eliminate the streaks, the diffusion layer on the substrate surface, formed by the electrolytic solution interacting with the substrate during the electrochemical removal process, is subjected to an agitation step selected from the group consisting of:

(i) directing ultrasonic sound at the substrate;

(ii) moving the substrate; and (iii) agitating the electrolytic solution, wherein the agitation step occurs during at least a portion of the electrochemical removal process. The agitation step (i.e., (i), (ii), or (iii)) can occur during the entire electrochemical removal process, wherein the agitation step is carried out continuously or repeated at intervals during a part of or throughout the entire electrochemical removal process.

The purpose of the agitation step is to disrupt the path with which the gas bubbles follow to the top of the electrolytic solution. The problem is that if the gas bubbles follow the same path, the portion of the diffusion layer corresponding to the bubble path is different than the areas that are not under the bubble path. This difference creates an appearance difference of an undesirable shiny streak on the substrate. By including an agitation step, the path of the gas bubbles is constantly changing, not allowing the streak to form.

One way of accomplishing the agitation step is by subjecting the substrate to sound waves such as ultrasonic sound. For example, one can employ a Prosonik model #40-PR-2324N with the transducers attached to a tank of about 90 liters capacity. The generator settings could yield positive results set at the maximum or minimum setting for the following parameters: wave functions of center frequency, band width, sweep time and time functions of train, degas, burst and quiet. Suggestive operating conditions might be center frequency 4–6, bandwidth 9–10, sweep time 0–2 and time functions of train 1–3, degas 4–6, burst 1–3 and quiet 2–4. The knobs on this device (i e., Prosonik model #40-PR-2324N) are numbered from 0 to 10. The numbers are arbitrary and do not correspond to exact values. From the Prosonic model #40-PR2324N manual we know the following:

Center frequency: 39.73 kHz–39.91 kHz;
Band width: 320 Hz–4 kHz;
Sweep time: 2 millisec–1 sec;
Train: 10 millisec–1 sec;
Degas: 10 millisec–1 sec;
Burst: 100 micro sec to 10 millisec; and
Quiet: 300 microsec to 10 millisec.

Another way of accomplishing the agitation step is by moving the substrate such as by shaking the substrate in for example an up and down motion (where the substrate is vertically disposed) at least once, preferably repeatedly. In embodiments, the shaking is such that the substrate is in constant motion during at least a part of the electrochemical removal process, preferably during the entire electrochemical removal process. When shaking the substrate, the movement preferably has a substrate surface velocity of at least about 50 mm per second relative to the electrolytic solution. Slower movement may be employed, e.g., about 3 mm per second if the direction of movement is changed or alternated, or if the surface velocity is accelerated or decelerated.

Another way of accomplishing the agitation step is by agitating the electrolytic solution such as by stirring the electrolytic solution with a stirring device, moving solution across the surface of the substrate such as by pumping the electrolytic solution in such a manner that there is a surface velocity created between the substrate and the electrolytic solution, or by bubbling air through the electrolytic solution.

By employing an agitation step as described herein, the streaks are reduced or eliminated, even at longer times and increased voltages for the electrochemical surface treatment. Thus, the agitation step provides the electrochemical surface treatment more process latitude.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated. Room temperature refers to a temperature of about degrees C.

EXAMPLE 1

An electrolyte of 113 mM sodium citrate solution was used with a 16.7 mM Borax and 33.3 mM HCl buffer. The workpiece was an aluminum alloy substrate similar to the ones used in the production of organic photoreceptors. The counterelectrode was a concentric titanium sheet covered with an electrolytically formed titanium-oxide layer. The counterelectrode diameter was approximately 18 centimeters. The electrolyses was carried at room temperature. An AC Power Source/Analyzer HP 6813A was used.

Prior to the electrolysis, the substrate was cleansed with a dilute citric acid cleaner under ultrasonic modulation followed by rinses in room temperature and hot deionized water (about 70 degrees C.). The dip in hot deionized water lasted 20 seconds. The substrate was dried in a room temperature oven for 5 minutes.

The RMS cell voltage was set to 20 volts with a bias of 6 volts (the substrate was the "hot" lead). A selected frequency of operation was 60 Hertz. The process time was 30 seconds. Multiple-point contacts were made to enhance current distribution. The substrate was then rinsed immediately in room temperature deionized water and immersed in hot deionized water (about 70 degrees C.) for 20 seconds prior to drying in a room temperature oven for five minutes. The gap between the working and the counterelectrodes was about 7.4 cm.

The surface finish was characterized optically with a Zeiss Metallurgical microscope. Electrochemical impedance spectroscopy was used to determine the electrical behavior of the formed oxide film. The instrument used was a Quadtech 7400 Precision RLC Meter. Five orders of magnitude of frequency were tested; linearity and reproducibility of the measurements were verified. It was determined from the low-frequency portion of the impedance spectrum that the thickness of the film formed was approximately 100–200 Å. For a superficial surface area of 0.22 $cm^2$, the impedance value measurably increased from about 3 kiloohms to about 21 kiloohms, measured at 60 Hz. The effect of the surface treatment (using deionized water as a wetting agent) was to measurably change the contact angle from 50 to 31 degrees, thereby measurably increasing the surface energy. The x-ray diffraction spectrum was recorded using the procedures described herein. The spectra for the treated and untreated surfaces were compared; superposition of the spectra showed that both surfaces were indistinguishable by this technique. Ellipsometric measurements were recorded according to the procedure described herein. The refractive index was approximately 4% lower for the treated surface which was considered a measurable change; also, an upper-bound for the resulting film was calculated at 2000 Å. The surface profile was measured using the procedures described herein. The results showed that the average roughness ($R_a$) and maximum roughness ($R_{max}$) varied by 5% and 3% respectively, which were considered measurably unchanged.

EXAMPLE 2

When the electrochemical cell was set up such that the electrolyte was 0.1 M of $KH_2PO_4$ and 0.1 M of $K_2HPO_4$ and a counter electrode of titanium and a substrate of aluminum, and there were applied a frequency of 60 Hz, an offset voltage of negative 6 volts, a voltage of 20 volts for a time of 20 seconds, no shiny streaks were generated on the substrate when ultrasonic sound was applied. The ultrasonic sound wave was applied for the entire duration of the electrochemical surface treatment. The ultrasonic sound was applied with a Prosonik model #40-PR-2324N with the transducers attached to a tank of about 90 liters capacity and settings of be center frequency 5, band width 10, sweep time 0 and time functions of train 2, degas 5, burst 2 and quiet 3. As explained earlier, the knobs on this device (i.e., Prosonik model #40-PR-2324N) were numbered from 0 to 10. The numbers were arbitrary and did not correspond to exact values. From the Prosonic model #40-PR-2324N manual we knew the following:

Center frequency: 39.73 kHz–39.91 kHz;
Band width: 320 Hz–4 kHz;
Sweep time: 2 millisec–1 sec;
Train: 10 millisec–1 sec;
Degas: 10 millisec–1 sec;
Burst: 100 micro sec to 10 millisec; and
Quiet: 300 microsec to 10 millisec.

COMPARATIVE EXAMPLE 1

The electrochemical treatment was carried out using the same procedures described in Example 2 except that no ultrasonic sound was applied. Shiny streaks were found on the substrate.

Other modifications of the present invention may occur to those skilled in the art based upon a reading of the present disclosure and these modifications are intended to be included within the scope of the present invention.

We claim:

1. A method for producing a photoreceptor having a substrate subjected to a surface finishing, treatment to result in a finished substrate surface, wherein the method comprises:

(a) analyzing the finished substrate surface by performing a first surface energy reading, a first ellipsometry reading, a first x-ray diffraction reading, and a first profilometry reading;

(b) removing electrochemically via an alternating voltage or alternating current a portion of the finished substrate surface, thereby resulting in a cleaned substrate surface;

(c) analyzing the cleaned substrate surface by performing a second surface energy reading, a second ellipsometry reading, a second x-ray diffraction reading, and a second profilometry reading, wherein the removing step (b) is accomplished to the extent that the second surface energy reading and the second ellipsometry reading are measurably changed from the first surface energy reading and the first ellipsometry reading, but the second x-ray diffraction reading and the second profilometry reading are measurably unchanged from the first x-ray diffraction reading and the first profilometry reading; and (d) depositing a layer of the photoreceptor on the cleaned substrate surface.

2. The method of claim 1, further comprising forming a metal oxide layer on the finished substrate surface during the removal step (b), performing a first electrochemical impedance reading of the finished substrate surface, and performing a second electrochemical impedance reading of the cleaned substrate surface, wherein the removing step (b) is accomplished to the extent that the second electrochemical impedance reading is measurably changed from the first electrochemical impedance reading.

3. The method of claim 2, wherein the metal oxide layer has a thickness ranging from about 50 to about 200 angstroms.

4. The method of claim 1, wherein the removing step (b) is accomplished at a pH ranging from about 3 to about 10.

5. The method of claim l, wherein the removing step (b) is accomplished at a frequency ranging from about 20 to about 500 Hz.

6. The method of claim 1, wherein the removing step (b) is accomplished at a time ranging from about 5 seconds to about 5 minutes.

7. The method of claim 1, wherein the substrate is a hollow cylinder.

8. The method of claim 1, wherein the surface energy of the cleaned substrate surface is increased by at least about 5% from the surface energy of the finished substrate surface.

9. The method of claim 1, wherein a contact angle of the cleaned substrate surface ranges from about 23 to about 33 degrees.

10. The method of claim 1, wherein (d) is accomplished by dip coating the layer of the photoreceptor on the cleaned substrate surface.

11. The method of claim 1, wherein the surface finishing treatment prior to (a) includes lathing the substrate surface.

12. The method of claim 1, wherein the surface finishing treatment prior to (a) includes spraying a mixture of a liquid and abrasive particles at the substrate surface.

13. The method of claim 1, wherein the substrate is at least partially immersed in an electrolytic solution, and further comprising a step (e) selected from the group consisting of:

(i) directing ultrasonic sound at the substrate;

(ii) moving the substrate; and (iii) agitating the electrolytic solution, wherein the stop (e) occurs during at least a portion of the removal step (b).

14. The method of claim 13, wherein the step (e)(ii) is accomplished by shaking the substrate.

15. The method of claim 13, wherein the step (e) occurs during the entire removal step (b).

* * * * *